US007213605B2

(12) United States Patent
Young

(10) Patent No.: US 7,213,605 B2
(45) Date of Patent: May 8, 2007

(54) JEWELRY CLEANING BASKET

(76) Inventor: David A. Young, 4230 Paul Rd., Cincinnati, OH (US) 45238-5845

( * ) Notice: Subject to any disclaimer, the term of this patent is extended or adjusted under 35 U.S.C. 154(b) by 381 days.

(21) Appl. No.: 10/753,671

(22) Filed: Jan. 8, 2004

(65) Prior Publication Data

US 2004/0163688 A1 Aug. 26, 2004

Related U.S. Application Data

(60) Provisional application No. 60/441,423, filed on Jan. 21, 2003.

(51) Int. Cl.
*B08B 3/02* (2006.01)

(52) U.S. Cl. ..... 134/134; 134/201

(58) Field of Classification Search ..... 134/134, 134/34, 201

See application file for complete search history.

(56) References Cited

U.S. PATENT DOCUMENTS

| | | | | | |
|---|---|---|---|---|---|
| 729,536 | A * | 6/1903 | Brown | 134/136 |
| 3,529,610 | A * | 9/1970 | Leichner et al. | 134/104.1 |
| 3,894,551 | A * | 7/1975 | Stohlman | 134/135 |
| 4,414,037 | A * | 11/1983 | Friedheim | 134/35 |
| 4,941,490 | A * | 7/1990 | Gross | 134/95.3 |
| 4,949,738 | A * | 8/1990 | Hubbard | 134/104.3 |
| 5,000,209 | A * | 3/1991 | Mann | 134/135 |
| 5,209,784 | A * | 5/1993 | Bellman | 134/25.4 |
| 6,076,538 | A * | 6/2000 | Frankson | 134/117 |
| 6,713,029 | B1 * | 3/2004 | Krafft et al. | 422/300 |

FOREIGN PATENT DOCUMENTS

JP 2002-325719 * 11/2002

* cited by examiner

*Primary Examiner*—Frankie L. Stinson
(74) *Attorney, Agent, or Firm*—Frost Brown Todd LLC

(57) ABSTRACT

An improved tool for cleaning a jewelry article (e.g., ring) accurately grips and positions the article yet captures any device affixed thereto (e.g., gemstone, jewel) while exposing the tool to a jewelry cleaning liquid (e.g., pressurized steam, ultrasonic liquid, ammonia solution, etc.). For instance, a spring-handled basket tool generally used for jewelry cleaning is improved by introducing a grasping member, such as an alligator clip with resiliency treated contact edges. The clip is affixed, such as by riveting, to one of two interior rings that define the opening between the two hemispheric baskets. A jewelry article that is thus clipped may be positioned to a desired angle for inspection and cleaning without fear of an expensive gem being lost due to the cleaning process.

4 Claims, 3 Drawing Sheets

JEWELRY CLEANING BASKET

CROSS REFERENCE TO RELATED APPLICATION

This application is based on and claims priority from U.S. Provisional Application No. 60/441,423, filed Jan. 21, 2003, which is incorporated herein by reference.

FIELD OF THE INVENTION

The present invention relates, in general, to tools used to hold jewelry during cleaning.

BACKGROUND OF THE INVENTION

Jewelry articles are cleaned with ultrasonic cleaning equipment, high-pressure steam, cleaning solutions, solvents, and other cleaning methods. These cleaning mediums are often inappropriate for extended contact with the skin of the user. Consequently, a number of tools are employed for positioning the jewelry article.

Grasping tools such as long-handled tweezers or hemostats are often used because the jewelry article may be affirmatively positioned for visual inspection and accurate cleaning. The jewelry article often includes a device (e.g., jewel, gemstone) that is affixed by one of a number of means: channel setting, pave setting, prong setting, tension setting, invisible setting, inlay, burnish setting, pick setting, glue setting, and pre-cast setting, etc. Often, the temperature, pressure and vibration of cleaning loosen a device (e.g., jewel, gemstone) mounted to the jewelry article. Grasping tools let a loosened jewelry device fall from the mounting, which can cause embarrassment, inconvenience or expense, especially if this loss occurs in the presence of a customer.

To avoid loss of a jewelry device, often an enclosed tool such as a basket is used. As a particular example, a spring-handled basket tool is used that opens a spherical basket formed from two hinged hemispheric wire baskets. Similar or identical spring-handled tools are more generally used for infusing loose tea in a tea cup. These basket tools do avoid the loss of jewelry devices. However, the jewelry article is allowed to tumble within the basket, which may prevent a thorough cleaning or may cause scratching.

Consequently, a significant need exists for an improved jewelry-cleaning tool that accurately positions a jewelry article while capturing any dislodged gemstones or jewels.

BRIEF SUMMARY OF THE INVENTION

The invention overcomes the above-noted and other deficiencies of the prior art by providing a tool for cleaning a jewelry article that affirmatively grasps the article while encompassing the article in a porous enclosure for capture of any jewelry device (e.g., gemstone, jewel, etc.) that should become dislodged during cleaning.

In one aspect of the invention, a spring-handled basket tool includes a clip affixed to the interior of the basket. Thereby, the jewelry article may be inspected or oriented to a cleaning medium. Moreover, the cleaning process has less risk of a mishap, thereby alleviating job stress for the user. In addition, the tool provides the ability to see the jewelry while under a stream of high pressure steam, enabling one to direct the steam under prongs, inside channel settings, and inside rings, without the loss of gems.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
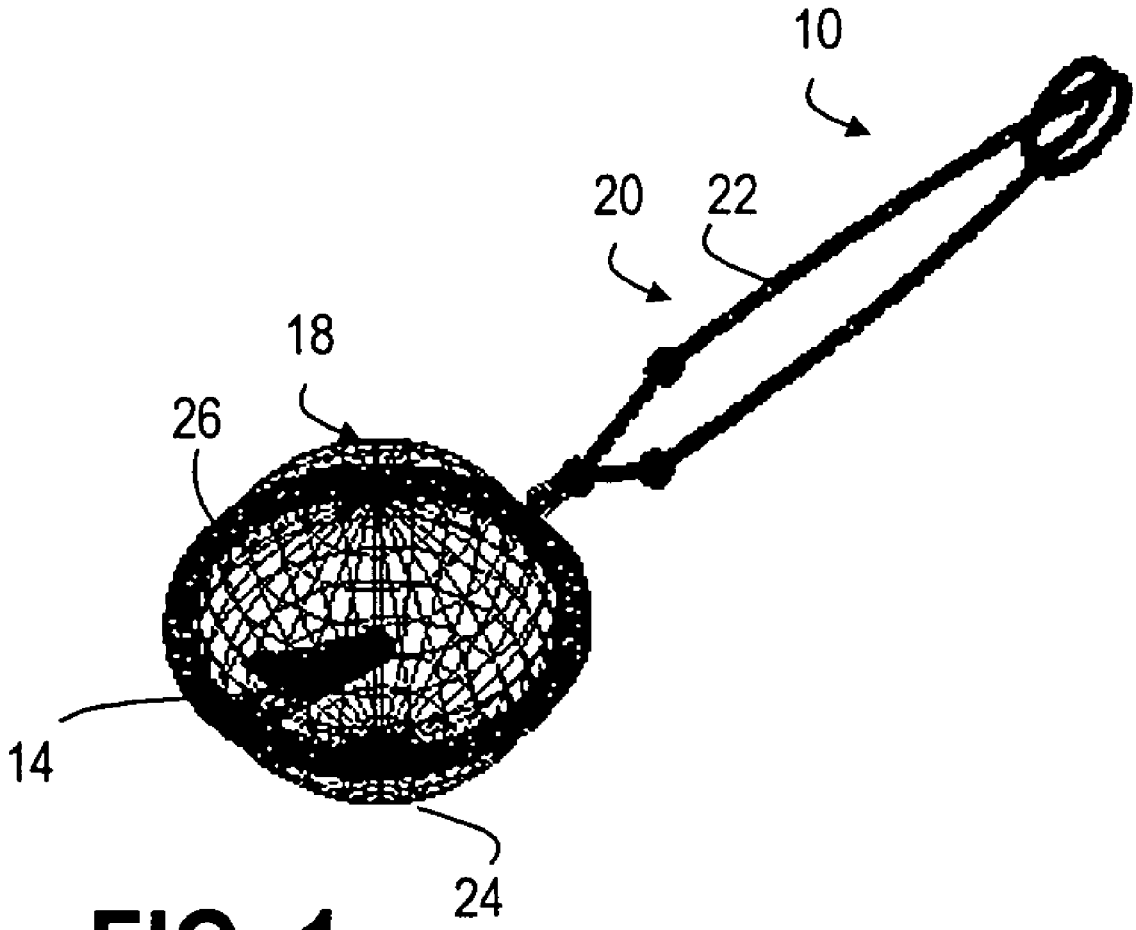
FIG. 1 is a perspective view of a closed, spring-handled basket tool having an inwardly oriented clip affixed to a basket rim.
Figure 2:
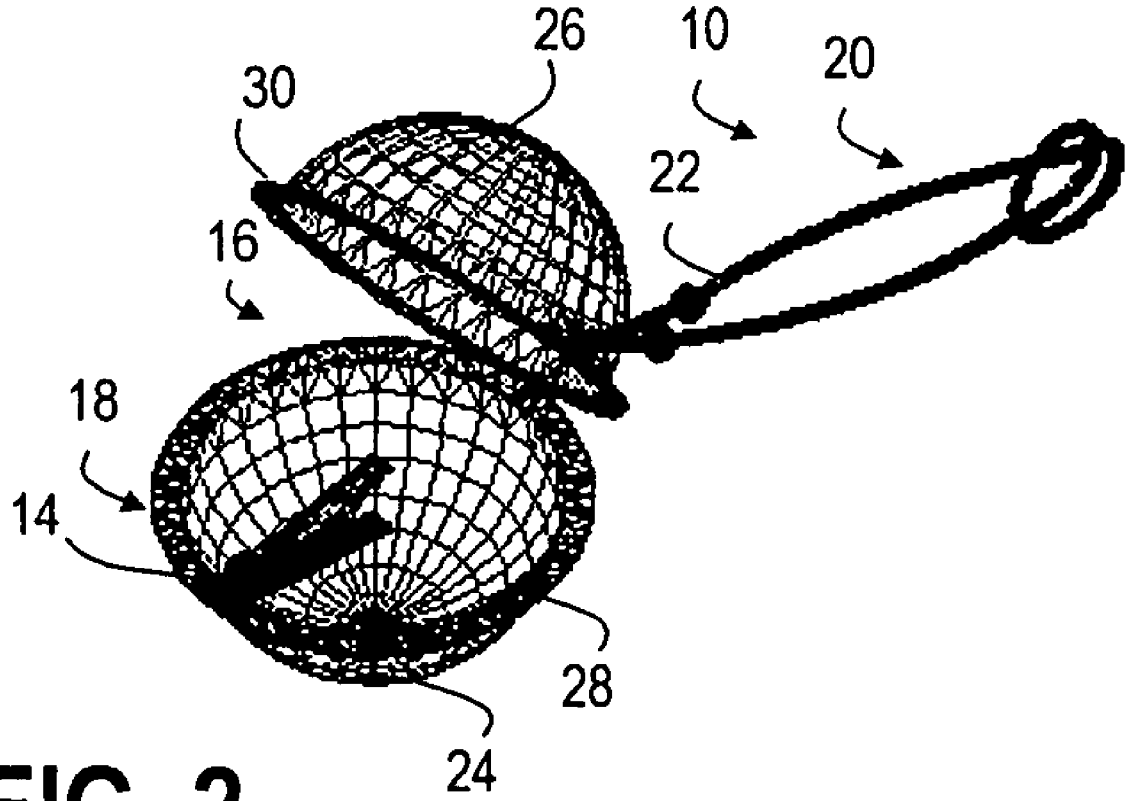
FIG. 2 is a perspective view of the spring-handled basket tool of FIG. 1 with the handle depressed to open the basket, exposing the clip for insertion of a jewelry article.
Figure 3:
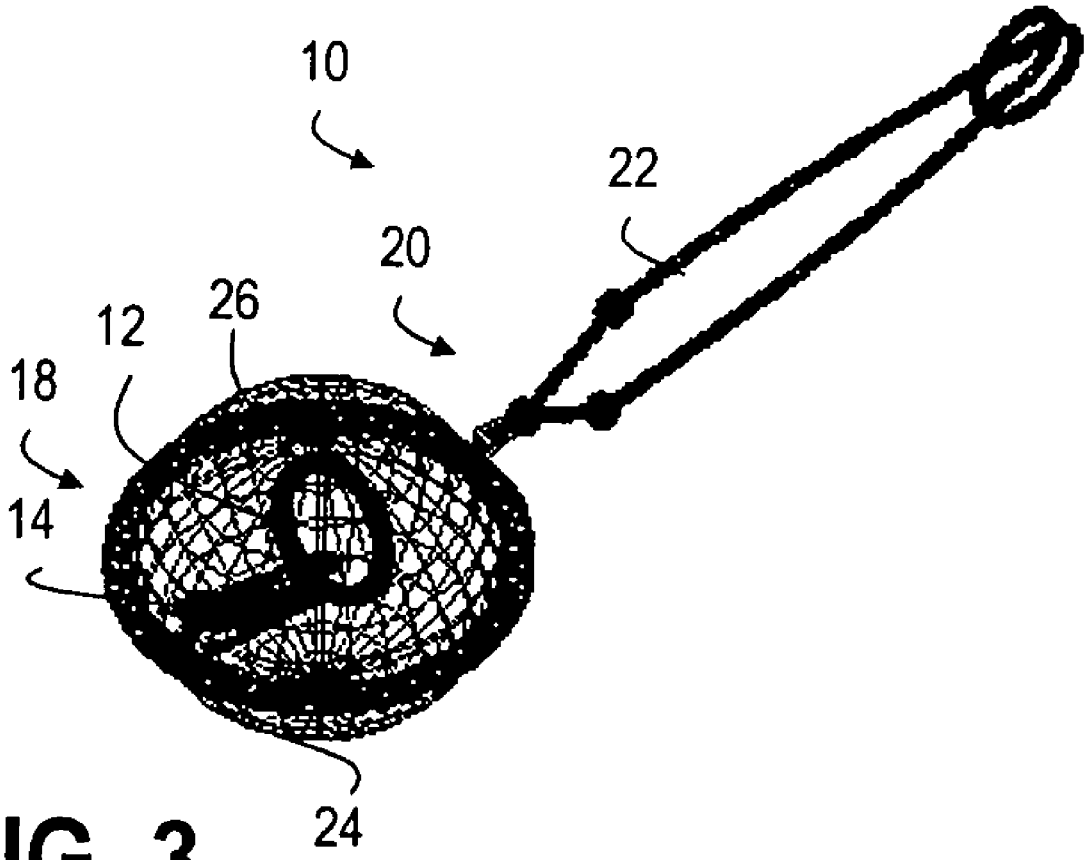
FIG. 3 is a perspective view of the spring-handled basket tool of FIGS. 1 and 2 with a jewelry article grasped and enclosed.

FIGS. 1–3 depict a tool 10 for holding jewelry article 12 during cleaning. In particular, a grasping member, depicted as an alligator clip 14 that is treated to prevent scratching of the jewelry article, is attached to an interior 16 of a porous enclosure 18. In the illustrative embodiment, the porous enclosure 18 is provided by a spring-handled basket tool 20 generally known for cleaning jewelry and for infusing loose tea. The porous enclosure 18 is thus provided by a selectively opened wire sphere 20 with a handle 22 biased to a closed position. The sphere 20 is formed from two pivoting hemispheres 24, 26, each contacting the other at a respective circular ring 28, 30. The lower ring 28 provides a convenient place for affixing (e.g., riveting, brazing) the clip 14.

The components may be selected from materials suitable for the cleaning environment and thus be resistant to corrosion. A clip 14 should be selected for having a soft contacting portion that does not mar the jewelry article 14 and have a resilient closing strength suitable to hold the article without damage. It may be desirable to also include a locking ring (not shown) that slides along the handle 22 and has a diameter such that the handle 22 is squeezed to hold open the hemispheres 28, 30.

In use, cleaning a jewelry article 12 is safely accomplished by clipping the jewelry article 12 to an interior of a basket that has porous openings to allow entry of a cleaning liquid. The basket is closed. Then the basket is positioned by an attached handle to expose the basket, and thereby the contained jewelry article 12, to the cleaning liquid (e.g., steam, ultrasonic, ammonia solution, etc.). With reference to FIG. 1, the tool 10 is initially closed and empty. In FIG. 2, the tool 10 is opened and the clip 14 is opened to receive a jewelry article 12. In FIG. 3, the jewelry article 12 has been clipped and the tool 10 closed for cleaning.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art. For example, other types of porous enclosures may be used that allow the introduction of cleaning steam, ultrasonic water, solutions, etc. Moreover, other types of selective openings may be used, such as a door. In addition, other grasping tools may be affixed to the interior of the enclosure. As another example, rather than relying upon spring action to close the tool 14 and the clip 14, affirming locking means may be employed.

What is claimed is:

1. A device for holding a jewelry article during cleaning with a cleaning liquid, comprising:

a selectably opened porous basket having an interior operable for entry of the cleaning liquid;

a grasping member affixed to the interior of the basket; and a handle attached to the basket, wherein the selectably opened basket and handle comprises a spring-handled strainer; and wherein the grasping member comprises a spring clip.

2. A device for holding a jewelry article during cleaning with a cleaning liquid, comprising:

a selectably opened porous basket having an interior operable for entry of the cleaning liquid;

a grasping member affixed to the interior of the basket operably configured to hold the jewelry article at fixed orientation relative to the porous basket; and a handle attached to the basket sized for manually holding and positioning the porous basket for visually inspecting and aiming a stream of the cleaning liquid toward a selected side of the jewelry article.

3. The device of claim 2, wherein the selectably opened basket and handle comprise a spring-handled strainer; and wherein the grasping member comprises a spring clip.

4. The device of claim 2, wherein the grasping member further comprises a soft contacting portion positioned to contact the jewelry article.

* * * * *